US009054422B2

(12) United States Patent
Tu et al.

(10) Patent No.: US 9,054,422 B2
(45) Date of Patent: Jun. 9, 2015

(54) ANTENNA

(71) Applicant: HON HAI PRECISION INDUSTRY CO., LTD., New Taipei (TW)

(72) Inventors: Hsin-Lung Tu, New Taipei (TW); Che-Ming Chang, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 166 days.

(21) Appl. No.: 13/849,531

(22) Filed: Mar. 24, 2013

(65) Prior Publication Data

US 2014/0152524 A1 Jun. 5, 2014

(30) Foreign Application Priority Data

Dec. 3, 2012 (TW) ..... 101145362 A

(51) Int. Cl.

| | |
|---|---|
| ***H01Q 11/00*** | (2006.01) |
| ***H01Q 1/24*** | (2006.01) |
| ***H01Q 1/52*** | (2006.01) |
| ***H01Q 1/48*** | (2006.01) |

(52) U.S. Cl.
CPC . *H01Q 1/521* (2013.01); *H01Q 1/48* (2013.01)

(58) Field of Classification Search
USPC ..... 343/700 MS, 702, 843
See application file for complete search history.

(56) References Cited

U.S. PATENT DOCUMENTS

| | | | | |
|---|---|---|---|---|
| 7,358,906 | B2 * | 4/2008 | Sato et al. | 343/702 |
| 7,701,401 | B2 * | 4/2010 | Suzuki et al. | 343/702 |
| 2006/0152411 | A1 * | 7/2006 | Iguchi et al. | 343/700 MS |
| 2007/0069958 | A1 * | 3/2007 | Ozkar | 343/700 MS |
| 2012/0068905 | A1 | 3/2012 | Ayatollahi et al. | |
| 2012/0105291 | A1 | 5/2012 | Tu | |

* cited by examiner

*Primary Examiner* — Tan Ho
(74) *Attorney, Agent, or Firm* — Novak Druce Connolly Bove + Quigg LLP

(57) ABSTRACT

An antenna includes a base, a ground layer printed on the base, a first antenna portion, a second antenna portion, and an isolation slot defined in the grounded layer. The isolation slot is arranged between the first antenna portion and the second antenna portion to reduce the interference between the first antenna portion and the second antenna portion.

7 Claims, 2 Drawing Sheets

ANTENNA

BACKGROUND

1. Technical Field

The present disclosure relates to antennas, and particularly, to a solid antenna.

2. Description of Related Art

Portable communication devices such as cellular phones include one or more antennas. Because space in the portable communication device is limited, space for the installation of the antenna is also limited. Therefore, a miniaturized antenna is needed

BRIEF DESCRIPTION OF THE DRAWINGS

Many aspects of the present disclosure should be better understood with reference to the following drawings. The units in the drawings are not necessarily drawn to scale, the emphasis instead being placed upon clearly illustrating the principles of the present disclosure. Moreover, in the drawings, like reference numerals designate corresponding portions throughout the several views.

DETAILED DESCRIPTION

Embodiments of the present disclosure will be described with reference to the accompanying drawings.

Figure 1:
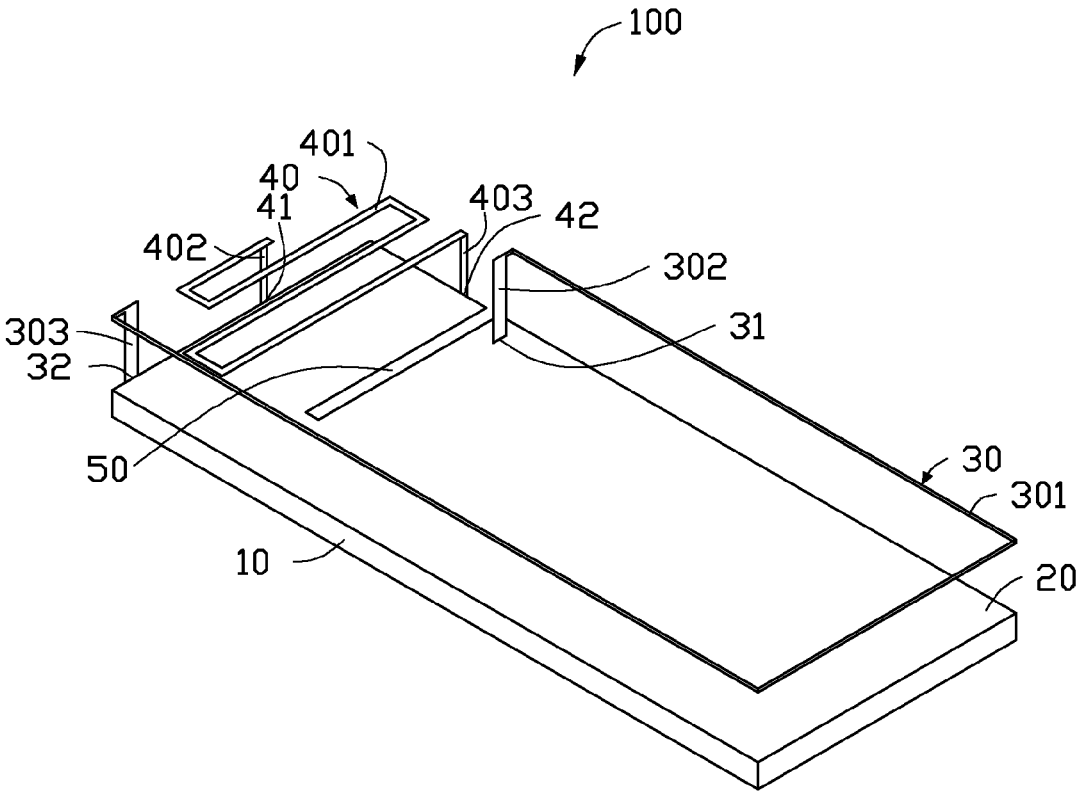
FIG. 1 is a schematic view of an antenna in accordance with an exemplary embodiment.

FIG. 1 is a schematic view of an antenna 100 in accordance with an exemplary embodiment. The antenna 100 includes a base 10, a ground layer 20, a first antenna portion 30, a second antenna portion 40, and an isolation slot 50.

The base 10 is a rectangular board, and is made of a dielectric material for supporting conductors made of copper foils or other materials. In the embodiment, the ground layer 20 is formed on the base 10.

The first antenna portion 30 is arranged on the base 10. The first antenna portion 30 includes a first main body 301 which is substantially parallel to the base 10 and is spaced a distance from the base 10. In this embodiment, the first main body 301 includes three metal strips which cooperatively form a substantially U-shaped structure as shown in FIG. 1. The two opposite strips of first main body 301 extend along the length of the base 10, and the remaining strip extends along the width of the base 10. In other embodiments, the main body 301 can be other shapes, such as circular.

The first antenna portion 30 further includes a first upright portion 302 perpendiculars to the ground layer. The first upright portion includes an upper end connected to one end of one long strip of the first main body 301, and a lower end electrically connected to the ground layer 20. The connection point between the first upright portion 302 and the ground layer 20 serves as a first grounded point 31. The first antenna portion 30 further includes a second upright portion 303 perpendiculars to the ground layer. The second upright portion includes an upper end connected to one end of the other long strip of the main body 301, and a lower end electrically connected to the base 10. The connection point between the second upright portion 303 and the base 10 servers as a first feeding point 32. In the embodiment, the first grounded point 31 and the first feeding point 32 are located on two adjacent edges of the base 10. The length of the first antenna portion 30 is equal to a wavelength of wireless signals transmitted or received by the antenna 100.

The second antenna portion 40 is arranged between the first upright portion 302 and the second upright portion 303. The second antenna portion 40 includes a second main body 401 which is substantially parallel to the base 10 and is spaced a distance from the base 10. In this embodiment, the second main body 401 is a strip arranged in a zigzag fashion. In other embodiments, the second antenna portion 40 may be varied according to need.

The second antenna portion 40 further includes a third upright portion 402 perpendicular to the ground layer. The third upright portion includes an upper end connected to one end of the second main body 401, and a lower end electrically connected to the base 10. The connection point between the third upright portion 402 and the base 10 servers as a second feeding point 41. The second antenna portion 40 further includes a fourth upright portion 403 perpendicular to the ground layer. The fourth upright portion 403 includes an upper end connected to another end of the second main body 401, and a lower end electrically connected to the ground layer 20. The connection point between the forth upright portion 403 and the ground layer 20 serves as a second grounded point 42. In the embodiment, the second grounded point 42 and the first feeding point 31 are positioned on a same edge of the base 10. The second feeding point 41 and the first grounded point 31 are positioned on a same edge of the base 10. In this embodiment, the length of the second antenna portion 40 is equal to half of a wavelength of wireless signals transmitted or received by the antenna 100.

The isolation slot 50 is a straight slot defined in the ground layer 20. The isolation slot 50 is arranged between the first antenna portion 30 and the second antenna portion 40, and extends along the widthwise direction of the base 10. In this embodiment, the length of the isolation slot 50 is equal to a quarter of the wavelength of the wireless signal transmitted or received by the antenna 100. The use of the isolation slot 50 is to isolate the first antenna portion 30 from the second antenna portion 40 to reduce the interference therebetween, in which the length of the isolation slot 50 can be varied according to need. In other embodiments, the isolation slot 50 can be other shapes, such as arcuate.

Figure 2:
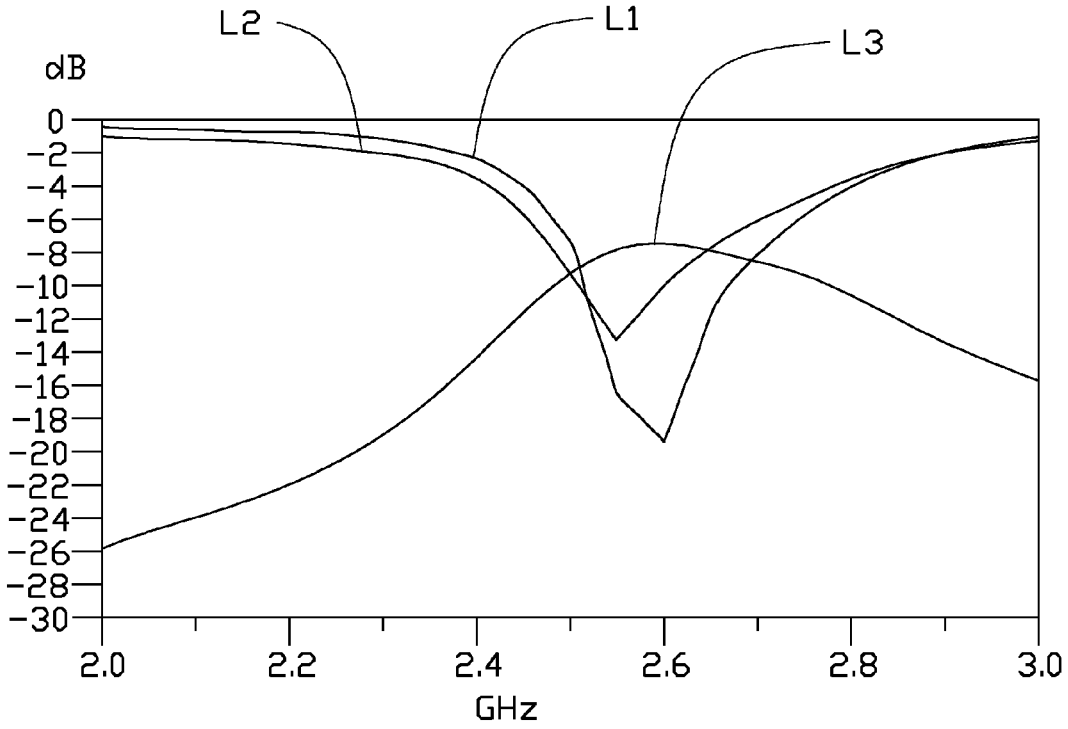
FIG. 2 is an electrical characteristics diagram of the antenna of FIG. 1.

FIG. 2 is an electrical characteristics diagram of the antenna 100 showing return loss of the antenna 100 at different frequencies. A first line L1 shows the return loss of the first antenna portion 30, a second line L2 shows the return loss of the second antenna portion 40, and a third line L3 shows the isolation degree between the first antenna portion 30 and the second antenna portion 40. It can be seen from the diagram when the frequency of the antenna 100 is in a range of 2.5-2.7 GHz, the return loss of the first antenna portion 30 and the second antenna portion 40 are all less than −6 dB, and the isolation degree between the first antenna portion 30 and the second antenna portion 40 is also less than −6 dB, both of which meet design requirements when the antennal 100 is used with a small sized printed circuit board.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being exemplary embodiments of the present disclosure.

What is claimed is:

1. An antenna comprising:

a base;

a ground layer formed on the base;

a first antenna portion comprising:

a first main body;

a first upright portion perpendicular to the ground layer, the first upright portion comprising a first end coupled to one end of the first main body and a second end electrically connected to the ground layer; and a second upright portion perpendicular to the ground layer, the second upright portion comprising an upper end connected to the first main body, and a lower end electrically connected to the base, a connection point between the first upright portion and the ground layer serving as a first grounded point, and a connection point between the second upright portion and the base serving as a first feeding point;

a second antenna portion arranged between the first upright portion and the second upright portion, the second antenna portion comprising:

a second main body;

a third upright portion perpendicular to the ground layer, the third upright portion comprising a top end connected to one end of the second main body, and a bottom end electrically connected to the base; and a fourth upright portion perpendicular to the ground layer, the fourth upright portion comprising a topmost end connected to the second main body, and a lowermost end electrically connected to the ground layer, a connection point between the third upright portion and the base serving as a second feeding point, and a connection point between the forth upright portion and the ground layer serving as a second grounded point; and an isolation slot being formed in the ground layer between the first antenna portion and the second antenna portion.

2. The antenna as described in claim 1, wherein the base is a rectangular board, and is made of a dielectric material.

3. The antenna as described in claim 2, wherein the first main body of the first antenna portion is substantially parallel to the base and is spaced a distance from the base, the first main body comprises three metal strips which cooperatively form a substantially U-shaped structure, two opposite metal strips of the first main body extend along a lengthwise direction of the base, and the remaining strip extends along a widthwise direction of the base.

4. The antenna as described in claim 3, wherein the length of the first antenna portion is equal to a wavelength of wireless signals transmitted or received by the antenna.

5. The antenna as described in claim 1, wherein the second main body of the second antenna portion is substantially parallel to the base and is spaced a distance from the base, and the second main body is a strip arranged in a zigzag fashion.

6. The antenna as described in claim 5, wherein the length of the second antenna portion is equal to half of a wavelength of wireless signals transmitted or received by the antenna.

7. The antenna as described in claim 5, wherein the isolation slot is a straight slot defined in the ground layer, and extends along the widthwise direction of the base.

* * * * *